US007544066B1

(12) United States Patent
Lynch et al.

(10) Patent No.: US 7,544,066 B1
(45) Date of Patent: Jun. 9, 2009

(54) ELECTRICAL CONNECTOR WITH FLEXIBLE INTERCONNECT

(75) Inventors: Stephen Brian Lynch, Alamo, CA (US); Jason Sloey, San Jose, CA (US); Cameron Frazier, San Carlos, CA (US); Mathias Schmidt, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/135,013

(22) Filed: Jun. 6, 2008

Related U.S. Application Data

(60) Provisional application No. 61/035,320, filed on Mar. 10, 2008.

(51) Int. Cl.
*H01R 12/00* (2006.01)

(52) U.S. Cl. ..... 439/77; 439/496

(58) Field of Classification Search ..... 439/67, 439/77, 493, 495–496
See application file for complete search history.

(56) References Cited

U.S. PATENT DOCUMENTS 3,065,446 A * 11/1962 Langzettel et al. ..... 439/496
3,154,365 A * 10/1964 Crimmins ..... 439/496
6,053,746 A * 4/2000 Yoshizawa ..... 439/67
6,514,089 B2 * 2/2003 Satou ..... 439/67

* cited by examiner

*Primary Examiner*—Khiem Nguyen

(57) ABSTRACT

An electrical connector that utilizes a flexible substrate for providing electrical contact surfaces within the electrical connector is disclosed. Advantageously, the electrical contact surfaces can be precisely formed on the flexible substrate such that manual assembly of individual contacts (e.g., pins) for a connector can be avoided. In one embodiment, the flexible substrate also facilitates connection of the electrical connector to other electrical components, such as other substrates, integrated circuits, etc., without having to solder leads or pins of a connector to a printed circuit board. In one implementation, the flexible substrate can be integrally formed with a system substrate.

22 Claims, 4 Drawing Sheets

ELECTRICAL CONNECTOR WITH FLEXIBLE INTERCONNECT

CROSS-REFERENCE TO RELATED APPLICATION

This application claims priority to U.S. Provisional Patent Application No. 61/035,320, filed Mar. 10, 2008, entitled "ELECTRICAL CONNECTOR WITH FLEXIBLE INTERCONNECT", which is herein incorporated herein by reference.

BACKGROUND OF THE INVENTION

1. Field of the Invention

The invention relates to connectors for electronic devices.

2. Description of the Related Art

Today, consumer electronic devices, such as personal computers, personal digital assistants, mobile telephones, and portable media players, often utilize one or more electrical connectors. These electrical connectors facilitate electrical connection with other devices, such as host computers, accessory devices, data networks, etc.

Since many consumer electronic device are portable and small, there is a desire to make the electrical connectors small. Unfortunately, in many cases, these electrical connectors are required to support a substantial number electrical contacts (e.g., 30 pins) within a constrained space. Moreover, conventional techniques for assembly of electrical connectors, particularly those having a substantial number of electrical contacts, is tedious, error prone and time consuming. Assembly of a system having such an electrical connector is also problematic because the electrical connector is manually attached (e.g., soldered) to the system's circuit board during assembly, which can require each of the substantial number of electrical contacts be individually soldered to the system's circuit board.

Thus, there is a need for improved approaches to assembling connectors and/or systems using connectors.

SUMMARY OF THE INVENTION

The invention pertains to an electrical connector that utilizes a flexible substrate for providing electrical contact surfaces within the electrical connector. Advantageously, the electrical contact surfaces can be precisely formed on the flexible substrate such that manual assembly of individual contacts (e.g., pins) for a connector can be avoided. In one embodiment, the flexible substrate also facilitates connection of the electrical connector to other electrical components, such as other substrates, integrated circuits, etc., without having to solder leads or pins of a connector to a printed circuit board. In one implementation, the flexible substrate can be integrally formed with a system substrate.

The invention may be implemented in numerous ways, including, but not limited to, as a method, system, device, or apparatus. Some exemplary embodiments of the invention are discussed below.

As an electrical connector, one embodiment of the invention can, for example, include at least: a metal shield, a molded internal structure that is electrically insulative and that includes a contact support protrusion, and a flexible electrical substrate having a plurality electrical contacts formed thereon. The flexible electrical substrate can be secured to the contact support protrusion, and the electrical contacts of the flexible electrical substrate can form electrical contacts for the electrical connector.

As an electrical connector, another embodiment of the invention can, for example, include at least: a metal shield, an internal structure that is electrically insulative and that includes a contact support protrusion, and an opening in the internal structure to receive a flexible electrical substrate having a plurality electrical contacts formed thereon, whereby the electrical contacts of the flexible electrical substrate form electrical contacts for the electrical connector.

As an electrical system assembly, one embodiment of the invention can, for example, include at least: a substrate for electrical interconnections, the substrate having a system portion and a flexible connector portion; and a connector housing having a grounding shield. The flexible connector portion of the substrate can be provided internal to the connector housing so as to provide electrical conductors within the connector housing.

As a consumer electronic product, one embodiment of the invention can, for example, include at least: a substrate for electrical components; and a housing for the consumer electronic product. The housing for the consumer electronic product can enclose the substrate and at least a portion of at least one electrical connector. The at least one electrical connector can be secured to the housing yet remain exposed and accessible from outside of the housing.

As a method for assembling a connector, one embodiment of the invention can, for example, include at least the acts of: providing an internal structure that is electrically insulative, the internal structure including a contact support protrusion; placing an end of a flexible electrical substrate proximate to the contact support protrusion of the internal structure, the end of the flexible electrical substrate having a plurality of exposed electrical contacts; and securing the end of the flexible electrical substrate to the internal structure.

Various aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, in which.

DETAILED DESCRIPTION OF THE INVENTION

The invention pertains to an electrical connector that utilizes a flexible substrate for providing electrical contact surfaces within the electrical connector. Advantageously, the electrical contact surfaces can be precisely formed on the flexible substrate such that manual assembly of individual contacts (e.g., pins) for a connector can be avoided. In one embodiment, the flexible substrate also facilitates connection of the electrical connector to other electrical components, such as other substrates (e.g., printed circuit board, flex circuit, rigid-flex circuit), integrated circuits, etc., without having to solder leads or pins of a connector to a printed circuit board. In one implementation, the flexible substrate can be integrally formed with a system substrate (e.g., flex circuit, rigid-flex circuit).

Exemplary embodiments of the invention are discussed below with reference to the various figures. However, those skilled in the art will readily appreciate that the detailed description given herein with respect to these figures is for explanatory purposes, as the invention extends beyond these embodiments.

Figure 1:
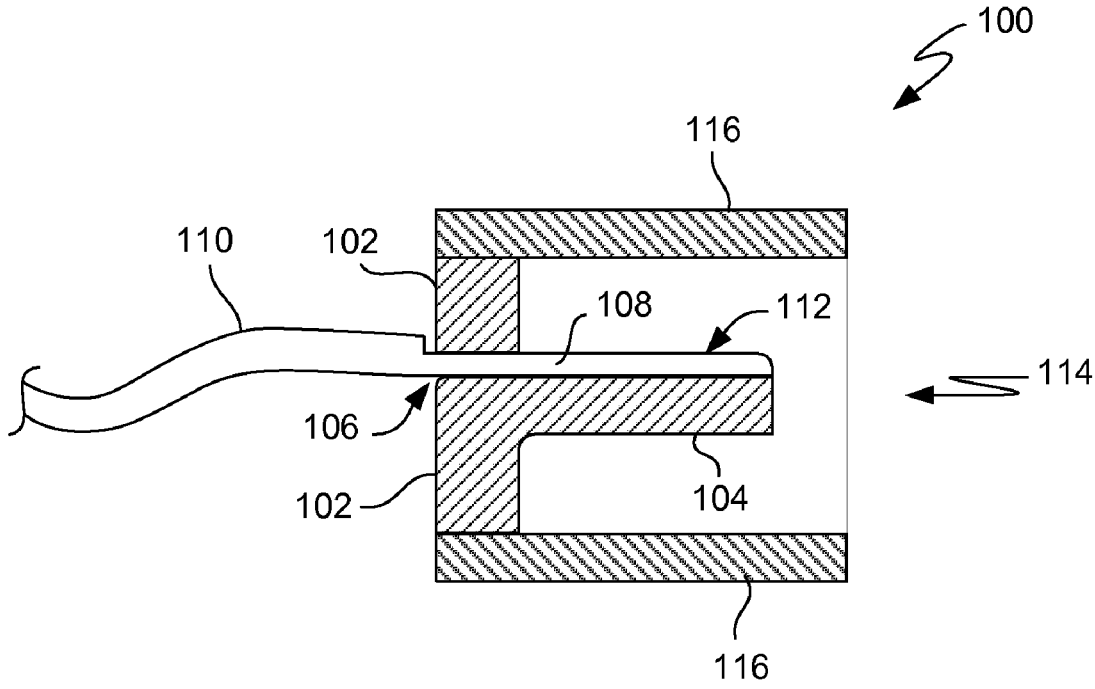
FIG. 1 is a cross-sectional view of an electrical connector according to one embodiment of the invention.

FIG. 1 is a cross-sectional view of an electrical connector 100 according to one embodiment of the invention. The electrical connector 100 includes an outer housing 116 and an inner structure 102 that serves as an inner housing for the electrical connector 100. The inner structure 102 includes a contact support protrusion 104. The contact support protrusion 104 serves to provide a support structure for electrical contacts that are used by the electrical connector 100. The electrical connector 100 has at least one opening 106 in the inner structure 102 to receive a contact end 108 of a flexible substrate 110. For example, the flexible substrate 110 can be a flexible printed circuit product, such as a flexible product (e.g., flex circuit or flexible printed circuit). The contact end 108 has a plurality of exposed contacts 112 on an upper surface. The contact end 108 can also be secured to the inner structure, such as the contact support protrusion 104 by any of a variety of different means, including adhesive, heat-steaks, rails/guides, recesses, or other mechanical means.

The electrical connector 100 provides an opening 114 for receiving a counterpart connector. When a counterpart connector connects with the electrical connector 100 via the opening 114, corresponding metal components within the counterpart connector make electrical connections with the corresponding exposed contacts 112, thereby making an electrical connection.

The use of the flexible substrate 110 to provide the exposed contacts 112 makes construction and assembly of the electrical connector 100 substantially less difficult than conventional approaches. Given that electrical connectors often support a plurality of contacts (e.g., pins), the ability to provide the contact surface in a single fabricated flexible substrate is a distinct improvement over the tedious manual process of assembling electrical contacts.

Figure 2:
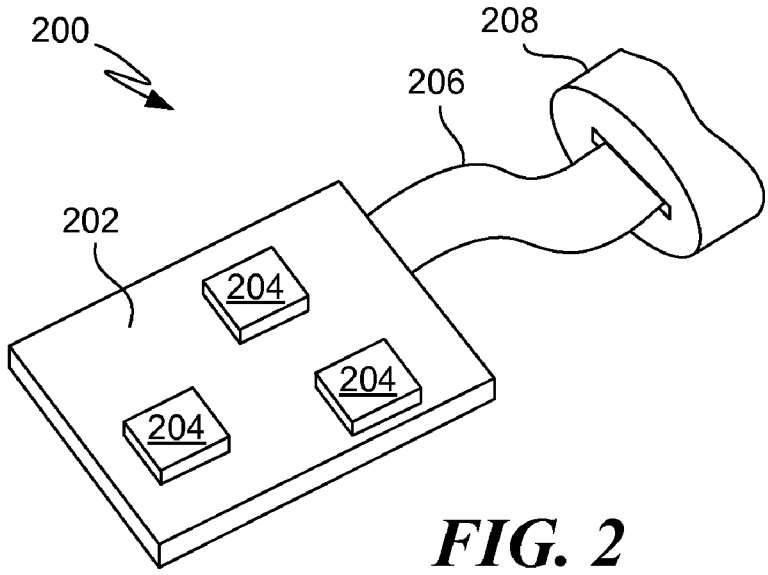
FIG. 2 is perspective view of an electrical connector assembly according to one embodiment of the invention.

FIG. 2 is perspective view of an electrical system assembly 200 according to one embodiment of the invention. The electrical system assembly 200 couples a substrate for electrical circuitry to a connector using a flexible portion of the substrate. The electrical system assembly 200 can also be referred to as an electrical connector assembly.

As illustrated in FIG. 2, the electrical system assembly 200 can include a system substrate 202 that includes electrical interconnections and bonding regions. Electrical components 204, such as integrated circuit chips, can be bonded (e.g., soldered) to the bonding regions of the system substrate 202. The system substrate 202 with the electrical components 202 can provide a system function for a consumer electronic device (see, e.g., FIG. 5). In order to support input/output operations, the system substrate 202 can include a flexible portion 206. In one embodiment, the flexible portion 206 is integral with the system substrate 202. The flexible portion 206 can include a plurality of interconnection traces that are provided to a connector 208. The connector 208 provides a physical input/output interface for the consumer electronic device. In one embodiment, an end of the flexible portion 206 can have exposed traces that are provided within the connector 208 and serve as electrical contact points or pins for the connector 208. The electrical connector 100 illustrated in FIG. 1 illustrates one implementation of such an embodiment. As an example, the flexible portion 206 can be a flexible printed circuit product.

Figure 3A:
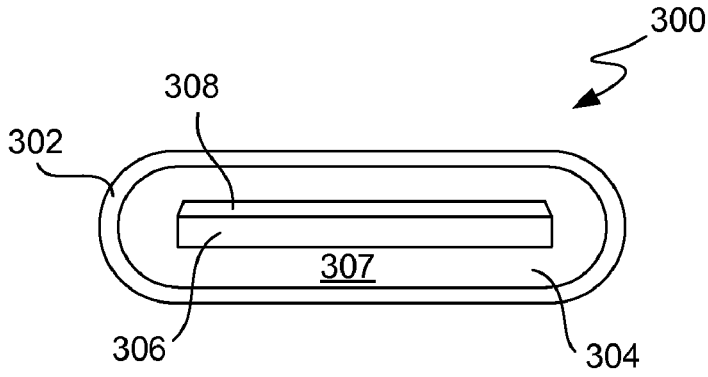
FIGS. 3A-3C are views of an electrical connector according to one embodiment of the invention.
Figure 3B:
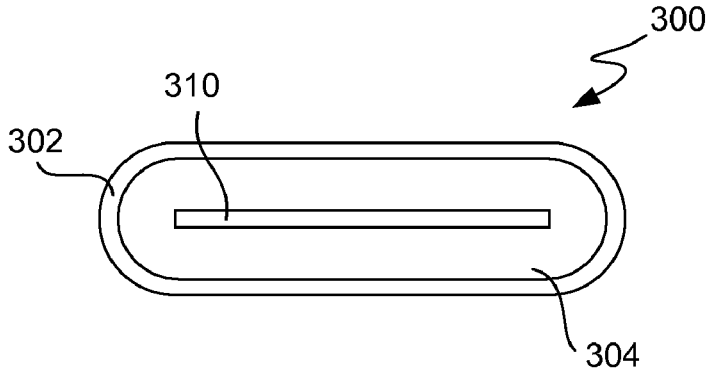
Figure 3C:
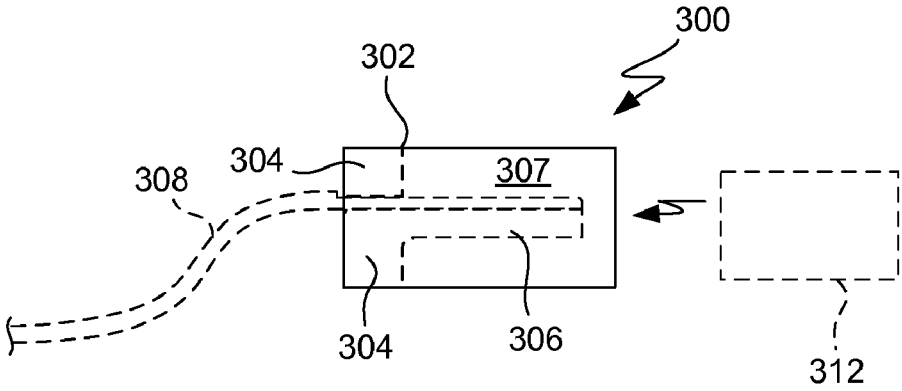

FIGS. 3A-3C are views of an electrical connector 300 according to one embodiment of the invention. FIG. 3A is a front view of the electrical connector 300, FIG. 3B is a rear view of the electrical connector 300, and FIG. 3C is a side view of the electrical connector 300.

As shown in FIG. 3A, the electrical connector 300 can have an outer housing 302. In one implementation, the outer housing 302 can formed of an electrically conductive material, such as a metal. The electrical connector 300 can also have an inner housing 304. In one implementation, the inner housing 304 can be formed of an electrically insulative material, such as plastic or resin. The inner housing 304 can form an extended central portion 306 and a cavity 307 within the electrical connector 300. A polyimide film 308 having exposed electrical contacts can be provided on the extended central portion 306. The polyimide film 308 can be used to electrically connect the electrical connector 300 to an external electronic component, such a flexible (system) circuit, semi-flexible (e.g., rigid-flex) circuit, printed circuit board, integrated circuit, etc. The rear view of the electrical connector 300, as shown in FIG. 3B, illustrates an opening 310 in the inner housing 304 that enables the polyimide film 308 to be supplied to the cavity 307 and provided on the extended central portion 306. However, it should be noted that, for ease of illustration, FIG. 3B does not depict the polyimide film 308. However, FIGS. 3A and 3C illustrate the polyimide film 308 provided on the extended central portion 306. More generally, the polyimide file 308 can be considered a flexible printed circuit product.

The cavity 307 allows a counterpart connector 312 to be inserted. When the counterpart connector 312 is inserted into the cavity 307 of the electrical connector 300, counterpart electrical contacts of the counterpart connector 312 can physically and electrically contact the exposed electrical contacts of the polyimide film 308. For example, the counterpart electrical contacts of the counterpart connector 312 can press against the exposed electrical contacts of the polyimide film 308 with a small bias force to ensure a stable and reliable electrical connection. In one embodiment, the polyimide film 308 can be Kapton® which is available from E. I. du Pont de Nemours and Company (DuPont).

Figure 4:
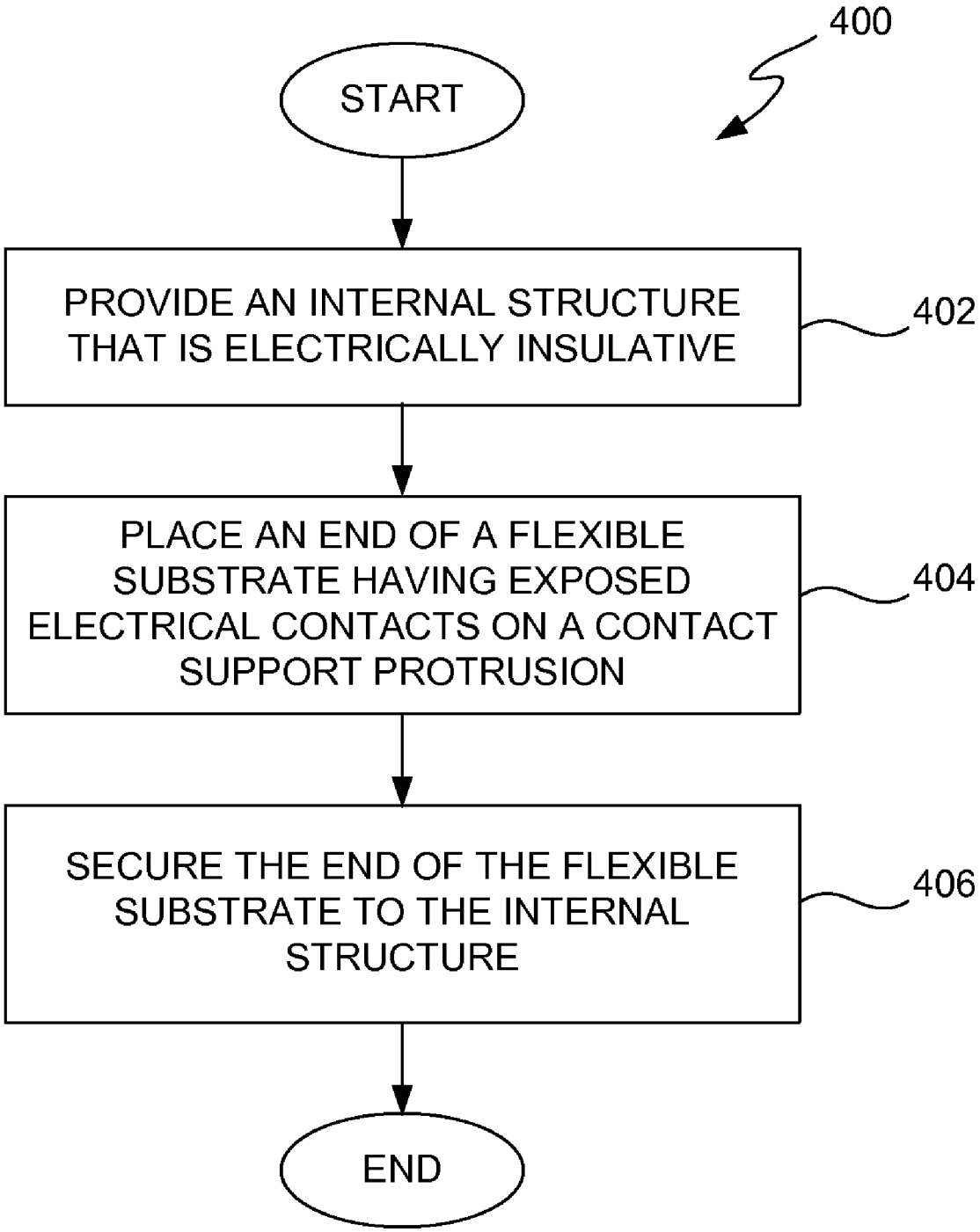
FIG. 4 is a flow diagram of a connector assembly process according to one embodiment of the invention.

FIG. 4 is a flow diagram of a connector assembly process 400 according to one embodiment of the invention. The connector assembly process 400 can be used to form an electrical connector, such as the electrical connector 100 illustrated in FIG. 1.

The connector assembly process 400 can begin by providing 402 an internal structure that is electrically insulative. The internal structure can be molded, such as injection molded, or otherwise formed. In one embodiment, the internal structure is formed to include a contact support protrusion (or extended central portion). Next, an end of a flexible substrate having exposed contacts can be placed on the contact support protrusion of the internal structure. The end of the flexible substrate can then be secured 406 to the internal structure.

In some embodiments, the electrical connector also has an outer structure. Typically, the outer structure is a conductive outer casing for the electrical connector. The conductive outer casing can, for example, surround the inner housing along one axis. The conductive outer casing can provide Electro-Static Discharge (ESD) protection to the electrical connector. In one implementation, the conductive outer casing is metal. Hence, in such embodiments, the connector assembly process 400 can further operate to provide the outer structure for the electrical connector. For example, the outer structure can be provided already attached with the internal structure at the block 402. In an alternative example, the outer structure can be provided and attached to the internal structure after any of the blocks 402, 404 or 406 of FIG. 4.

In some embodiments, an electrical connector can be integral with or secured to a housing of a consumer electronic product. By integrating or securing the electrical connector with or to a housing, the electrical connector can be firmly coupled to the housing such that external forces applied to the connector are transferred to the housing and not to other internal components, such as a solder connections. Since the housing has greater mass and structural integrity, external forces applied to the connector can thus be better absorbed by the housing.

Figure 5:
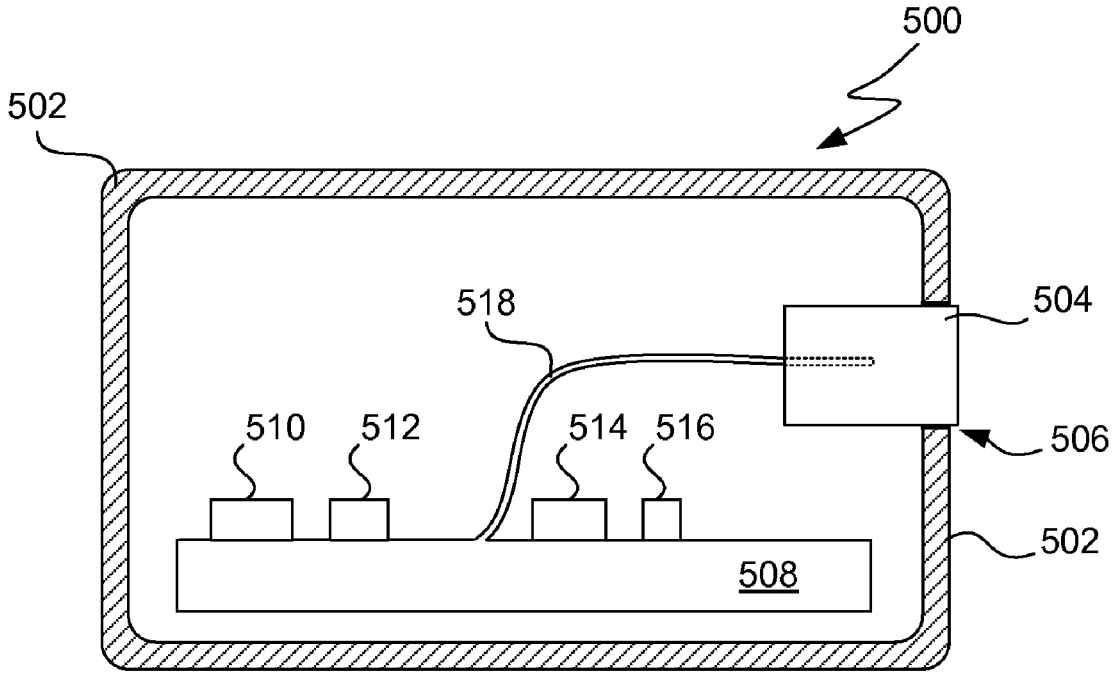
FIG. 5 is a cross-sectional view of an exemplary consumer electronic device according to one embodiment of the invention.

FIG. 5 is a cross-sectional view of an exemplary consumer electronic device 500 according to one embodiment of the invention. The consumer electronic device 500 has a housing 502. An electrical connector 504 is provided at an opening 506 in the housing 502. The electrical connector 504 is also secured to the housing 502. The housing 502 serves to encompass electrical components of the consumer electronic device 500. The electrical components can be different for different electronic devices. For example, the consumer electronic device 500 can pertain to a personal computer, a personal digital assistant, a portable media player, a mobile telephone, etc. As shown in FIG. 5, the electrical components can include a system board 508 that includes various components 510-516 mounted thereon. A flexible extension 518 of the system board 508 is also provided within the housing 502 and serves to electrically connect the system board 508 to the connector 504. In particular, as noted above, the flexible extension 518 (e.g., flexible substrate) can provide (i) electrical connection from the connector 504 and the system board 508, and (ii) conductive traces at the connector 504 that service to permit electrical interconnection with a counterpart connector (when the connectors are connected). Further, since the electrical connector 504 is secured to the housing 502, mechanical forces induced on the electrical connector 504 can be imposed on and absorbed by the housing 502, thereby isolating the system board 508 from such forces where they would be problematic.

In one embodiment, the flexible extension 518 is flexible printed circuit product, such as a flex circuit. In one implementation, these flexible printed circuit products utilize a polyimide film, such as Kapton®. The system board 508 can be a flexible substrate (e.g., flex circuit) or a semi-rigid substrate (e.g., rigid-flex circuit).

The invention can be utilized in a variety of different devices (e.g., electronic devices) including, but not limited to including, portable and highly compact electronic devices (i.e., portable electronic devices) with limited dimensions and space. In one embodiment, a device may be a laptop computer, a tablet computer, a media player, a mobile phone (e.g., cellular phone), a personal digital assistant (PDA), substantially any handheld electronic device, a computer mouse, a keyboard, a remote control, substantially any computer accessory, and/or substantially any computer peripheral. Typically, the electronic devices include at least one electrical component inside its housing. The electrical component can, for example, be an integrated circuit or circuit board. Examples of integrated circuits include memory, processor (microprocessor or controller), ASIC, and various others.

The various aspects, features, embodiments or implementations of the invention described above can be used alone or in various combinations.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. An electrical connector, comprising:

a metal shield forming an interior cavity of said electrical connector;

a molded internal structure that is electrically insulative, said molded internal structure including a contact support protrusion and an opening, the contact support protrusion extending laterally from the opening into the interior cavity of said electrical connector; and a flexible electrical substrate having a plurality electrical contacts formed thereon, said flexible electrical substrate being secured to the contact support protrusion, wherein the electrical contacts of said flexible electrical substrate form electrical contacts for said electrical connector.

2. An electrical connector as recited in claim 1, wherein the said electrical connector includes at least thirty electrical contacts all supported by the electrical contacts of said flexible electrical substrate.

3. An electrical connector as recited in claim 1, wherein said flexible electrical substrate comprises a film.

4. An electrical connector as recited in claim 1, wherein said flexible electrical substrate comprises a plurality of thin layers, at least one layer including metal and at least another later including polyimide.

5. An electrical connector, comprising:

a metal shield forming an interior cavity of said electrical connector;

a molded internal structure that is electrically insulative, said molded internal structure including a contact support protrusion; and an opening in said internal structure to receive a flexible electrical substrate having a plurality electrical contacts formed thereon, whereby the electrical contacts of said flexible electrical substrate form electrical contacts for said electrical connector, wherein the contact support protrusion extends laterally from the opening into the interior cavity of said electrical connector.

6. An electrical connector as recited in claim 5, wherein said flexible electrical substrate comprises a film.

7. An electrical system assembly, comprising:

a substrate for electrical interconnections, said substrate having a system portion and a flexible connector portion;

a connector housing having a grounding shield; and a molded internal structure housed within said connector housing including a contact support protrusion and an opening, wherein the contact support protrusion extends laterally from the opening into an interior cavity of said connector housing, wherein the flexible connector portion of said substrate is provided internal to said connector housing so as to provide electrical conductors within said connector housing.

8. An electrical system assembly as recited in claim 7, wherein a complementary connector can electrically couple with the electrical conductors within said connector.

9. An electrical system assembly as recited in claim 7, wherein said connector housing further including an insulator, the flexible connector portion of said substrate is provided on a surface of the insulator.

10. An electrical system assembly as recited in claim 9, wherein the flexible connector portion of said substrate is attached to the surface of the insulator.

11. An electrical system assembly as recited in claim 10, wherein the flexible connector portion of said substrate has a plurality of metal traces disposed thereon.

12. An electrical system assembly as recited in claim 7, wherein the system portion of said substrate is less flexible than the flexible connector portion.

13. An electrical system assembly as recited in claim 7, wherein the electrical conductors of the flexible connector portion are provided internal to said connector housing and electrically coupled to the system portion without use of solder or additional metal components.

14. An electrical system assembly as recited in claim 7, wherein the system portion of said substrate includes bonding regions for receiving electronic components.

15. A consumer electronic product, comprising:

a substrate for electrical components;

a housing for said consumer electronic product, said housing encloses said substrate and at least a portion of at least one electrical connector;

a flexible interconnect configured to electrically connect the at least one electrical connector to said substrate; and a molded internal structure housed within the at least one electrical connector including a contact support protrusion and an opening, the contact support protrusion and opening configured to receive one end of said flexible interconnect, wherein the contact support protrusion extends laterally from the opening into an interior cavity of the at least one electrical connector, and wherein the at least one electrical connector is secured to said housing yet remains exposed and accessible from outside of said housing.

16. A consumer electronic product as recited in claim 15, wherein the at least one electrical connector is mechanically supported by said housing, and wherein the at least one electrical connector is not mechanically supported by said substrate.

17. A consumer electronic product as recited in claim 15, wherein the flexible interconnect is a contiguous extension of said substrate.

18. A consumer electronic product as recited in claim 17, wherein the flexible interconnect comprises a plurality of thin layers, at least one layer including metal and at least another later including polyimide.

19. A consumer electronic product as recited in claim 15, wherein the flexible interconnect comprises a plurality of thin layers, at least one layer including metal and at least another later including polyimide.

20. A method for assembling a connector, said method comprising:

providing an internal molded structure that is electrically insulative, the internal structure including a contact support protrusion and an opening, molding the contact support protrusion to extend laterally from the opening into an interior cavity of the connector;

placing an end of a flexible electrical substrate proximate to the contact support protrusion of the internal structure, the end of the flexible electrical substrate having a plurality of exposed electrical contacts; and securing the end of the flexible electrical substrate to the internal structure.

21. A method as recited in claim 20, wherein said method further comprises:

providing an outer structure that is electrically conductive, wherein the outer structure is provided or placed around the inner structure.

22. A method as recited in claim 20, wherein said providing of the internal structure comprises injection molding.

* * * * *